US007045751B2

(12) United States Patent
Kim

(10) Patent No.: US 7,045,751 B2
(45) Date of Patent: May 16, 2006

(54) HEATING APPARATUS OF MICROWAVE OVEN AND FOOD HEATING METHOD

(75) Inventor: Seog Tae Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/508,148

(22) PCT Filed: Mar. 15, 2004

(86) PCT No.: PCT/KR2004/000542

§ 371 (c)(1),
(2), (4) Date: Sep. 17, 2004

(87) PCT Pub. No.: WO2004/097302

PCT Pub. Date: Nov. 11, 2004

(65) Prior Publication Data

US 2005/0139592 A1 Jun. 30, 2005

(30) Foreign Application Priority Data

Apr. 28, 2003 (KR) ..... 10-2003-0026738

(51) Int. Cl.
*H05B 6/80* (2006.01)

(52) U.S. Cl. ..... 219/685; 219/681

(58) Field of Classification Search ..... 219/685, 219/763, 404, 702, 704, 708, 754, 756, 749, 219/751, 752–753, 762, 648, 478, 476, 395–398, 219/681; 99/325

See application file for complete search history.

(56) References Cited

U.S. PATENT DOCUMENTS

| | | | | |
|---|---|---|---|---|
| 4,596,914 A * | 6/1986 | Morino | 219/681 |
| 5,534,681 A | 7/1996 | Hwang | |
| 5,793,023 A | 8/1998 | Hong et al. | |
| 5,938,959 A * | 8/1999 | Wang | 219/401 |
| 6,091,057 A | 7/2000 | Asami et al. | |

FOREIGN PATENT DOCUMENTS

| | | |
|---|---|---|
| JP | 3-251616 A | 11/1991 |
| JP | 1998-022696 | 7/1998 |
| JP | 2003-106534 | 4/2003 |
| JP | 2003106534 A * | 4/2003 |
| KR | 1999-0015213 U | 5/1999 |

* cited by examiner

*Primary Examiner*—Quang Van
(74) *Attorney, Agent, or Firm*—McKenna Long & Aldridge LLP

(57) ABSTRACT

The present invention provides a heating apparatus of a microwave oven. The heating apparatus includes: an upper heater installed at an upper portion of a cavity; a lower heater installed at a lower portion of the cavity and allowing an inclination to be selectively formed; a tray placed on the lower heater, for receiving a food thereon; and a motor connected to the lower heater so as to incline the lower heater on which the tray is placed.

19 Claims, 7 Drawing Sheets

HEATING APPARATUS OF MICROWAVE OVEN AND FOOD HEATING METHOD

TECHNICAL FIELD

The present invention relates to a heating apparatus of a microwave oven, and more particularly, to a heating apparatus of a microwave oven that can move a tray with a food thereon up and down by rotating a movable heater provided on a lower portion of the microwave oven to cook a food quickly.

BACKGROUND ART

A microwave oven is a cooking apparatus, which generates a microwave to heat foods with electricity as a power source. The microwave oven is very suitable to cook an unbaked food to be cooked with ingredients or a precooked food such as an instant food.

Recently, a composite heating microwave oven is well known, which heats a food therein by an additional heater in a cavity as well as by microwave.

The additional heater of the composite heating microwave oven is fixed on a ceiling or a lower portion of a cavity of the oven. Accordingly, when a food is placed on a tray of the cavity and cooked, the additional heater works at a fixed location regardless of the amount or the volume of the food. However, in this case, the heat from the additional heater cannot be used efficiently and the food is not cooked very well.

FIG. 1 is a perspective view of a microwave oven provided with a heating apparatus according to the related art.

Referring to FIG. 1, the related art heating apparatus includes a cavity 1, an upper plate 3 and an upper heater 2. The cavity 1 receives a food to cook. The upper plate 3 constitutes a ceiling of the cavity 1. The upper heater 2 is installed under the upper plate 3 and heats the food.

A rotation tray 5 is installed at the lower portion of the cavity 1, and is rotatable in a state that a food is placed thereon. A separate lower heater 4 is installed under the rotation tray 5.

Here, the upper heater 2 is fixed in the vicinity of the upper plate 3 positioned at an upper portion of the cavity 1. The tray 5 and the lower heater 4 are installed at the lower portion of the cavity 1.

In this related art microwave oven, when it is intended to heat a food by using the heaters, the microwave oven is turned on and the upper and lower heaters 2 and 4 generate heat.

The heat is merged into the airflow circulating inside the cavity 1 to form a thermal current, so that the heat is delivered to the food by convection.

Accordingly, the upper heater 2 heats a comparatively distant upper surface of the food while the lower heater 4 heats a comparatively near lower surface of the food. Also, the microwave oven heats the food by microwave of magnetron (not shown).

However, since the upper and lower heaters 2 and 4 and the rotation tray 5 are fixed to the upper and lower portions of the cavity 1 respectively, the distances between the food on the rotation tray 5 and the heaters 2 and 4 are always constant regardless of the type and the size of the food. Accordingly, it is limited to optimize a cook condition of the food.

In addition, since the lower heater 4 is near to the food but the upper heater 5 is comparatively distant from the food as shown in FIG. 1, some of the thermal current generated by the upper heater 2 is not utilized to heat the food.

DISCLOSURE OF THE INVENTION

Accordingly, the present invention is directed to a heating apparatus of a microwave oven and food heating method that substantially obviates one or more of the problems due to limitations and disadvantages of the related art.

An object of the present invention is to prepare an innovative lower heater capable of moving a tray up and down and controlling position of the tray with a food thereon gradually according to the type and the size of the food thereby to optimize the cook condition and to maximize energy efficiency.

According to the present invention, since the tray with the food thereon is lifted up to the upper heater by rotation of the heater, the food is cooked quickly and cooking time is shortened. The heat generated by the upper heater is efficiently irradiated on the food thereby to maximize energy efficiency of the upper heater.

Further, since the height of the tray is controllable according to the size and the type of the food, the food is uniformly heated thereby to more properly cook the food.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, there is provided a heating apparatus of a microwave oven including: an upper heater installed at an upper portion of a cavity; a lower heater installed at a lower portion of the cavity and allowing an inclination to be selectively formed; a tray placed on the lower heater, for receiving a food thereon; and a motor connected to the lower heater so as to incline the lower heater on which the tray is placed.

According to the present invention described above, the tray is adjustable in height according the rotation angle of the lower heater thereby to optimize the cook condition and to maximize energy efficiency.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Hereinafter, preferred embodiments of the present invention will be described in detail with reference to accompanying drawings.

Figure 1:
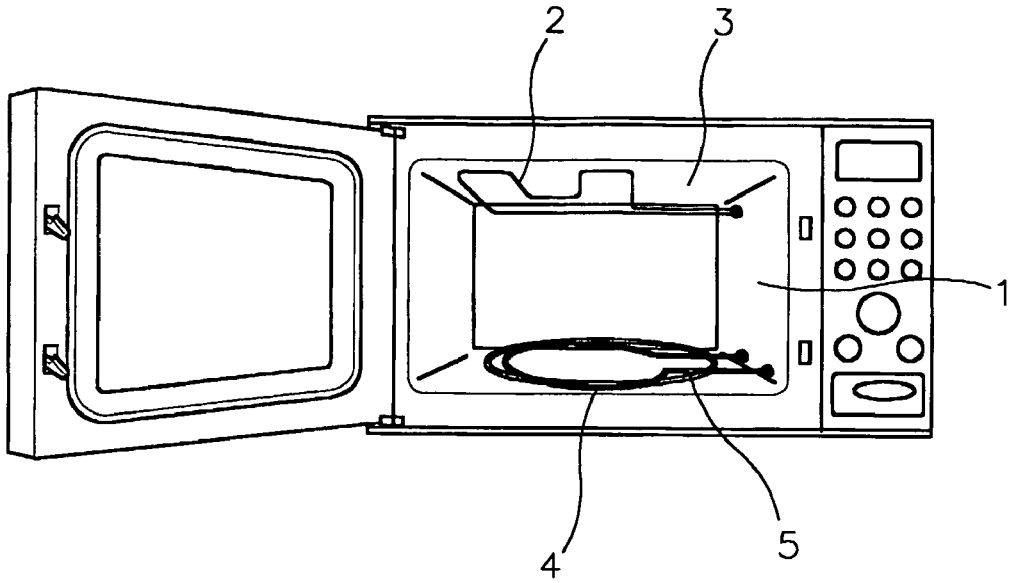
Fig.1 (Related Art)
FIG. 1 is a perspective view of a conventional microwave oven.
Figure 2:
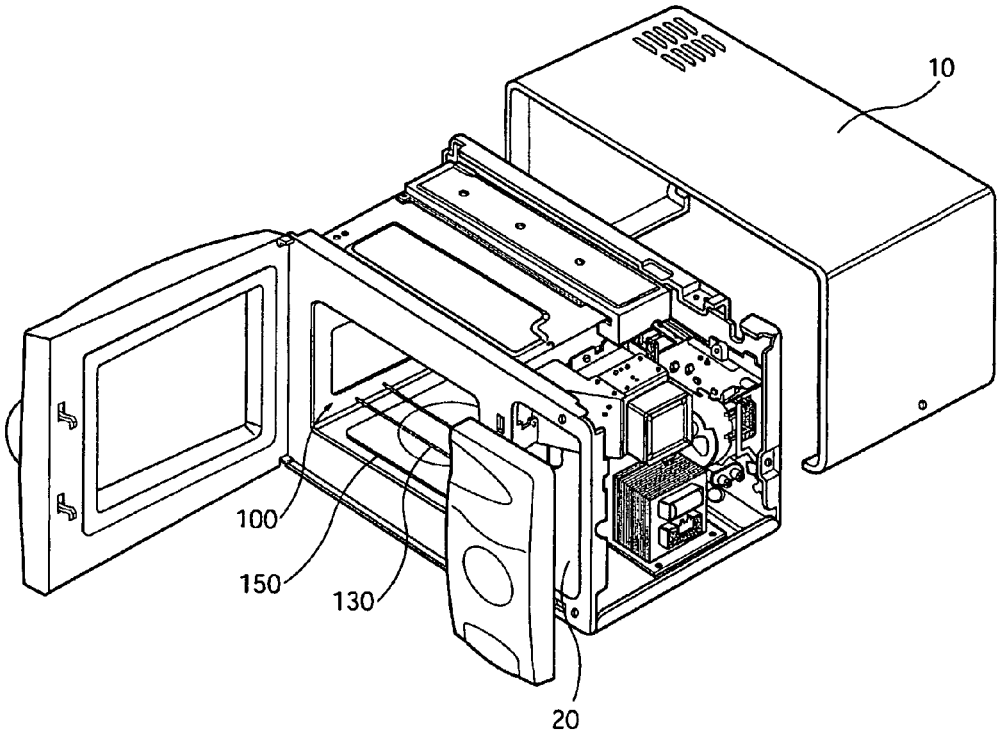
Fig.2 (Related Art)
FIG. 2 is a perspective view of a microwave oven according to the present invention.
Figure 3:
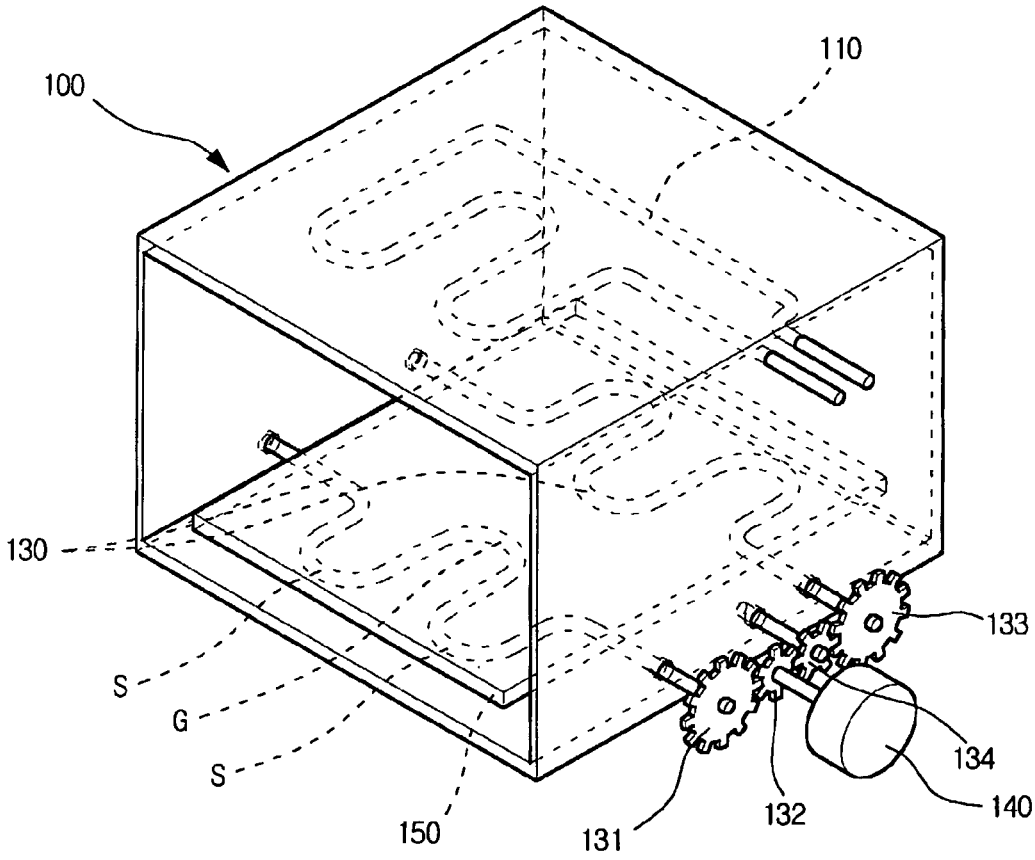
FIG. 3 is a perspective view of a heating apparatus of a microwave oven according to the present invention.

FIG. 2 is a perspective view of a microwave oven according to the present invention. FIG. 3 is a perspective view of a heating apparatus of a microwave oven according to the present invention.

Referring to FIGS. 2 and 3, the microwave oven includes an outer casing 10, a cavity 100, a tray 150, and an electronic components room 20. The cavity 100 forms a cooking space in the outer casing 10. The tray 150 is placed on the lower portion of the cavity 100 to receive a food thereon. The electronic components room 20 is disposed at a side inside the outer casing 10 to accommodate various components necessary to operate the microwave oven.

Inside the electronic components room 20, installed are a magnetron for generating microwave, a wave guide for guiding the microwave generated by the magnetron to a cooking chamber, a high voltage transformer for generating and supplying high voltage to drive the magnetron, a high voltage capacitor, and a cooling fan for cooling the electronic parts such as the magnetron, high voltage transformer and high voltage capacitor and discharging an inside vapor.

In order to solve non-uniform heating problem of the related art, the lower heater 130 installed in the cavity is designed to have different shape from the related art lower heater 4 and to be capable of moving.

In addition, the heating apparatus according to the present invention includes an upper heater 110, a lower heater 130, a tray 150 and a motor 140. The upper heater 110 is installed at an upper portion of a cavity 100 to heat a food. The lower heater 130 is installed at a lower portion of the cavity 100 and allows an inclination to be selectively formed due to its rotation. The tray 150 is placed on the lower heater 130 and receives a food thereon. The motor 140 inclines the lower heater 130.

The upper heater 110 is installed at an upper portion of a cavity 100 to heat a food. Preferably, the upper heater 110 has a plurality of bent portions to enhance caloric power, and extends and projects to the electronic components room 20.

The electricity is connected to the upper heater 110 extended to the electronic components room 20 and emits heat due to its electric resistance.

The at least one lower heater 130 is installed at the lower portion of the cavity 100, has bent portions, and extends and projects to the electronic components room 20 as like the upper heater 110. The extended lower heater 110 is supplied with electricity and emits heat to the outside due to its electric resistance.

In this embodiment of the present invention, the lower heater 130 consists of a first lower heater and a second lower heater, and they are placed symmetrical to each other. The number of the lower heaters, however, is not limited by this embodiment. The optimal number of the lower heaters can be determined according to the size and the thermal efficiency of the microwave oven and the shape of the lower heater 130.

As shown in FIG. 3, each of the lower heaters 130 has two ridges S and one furrow G and both ends of the lower heaters 130 form straight.

The shapes and the numbers of the ridges and the furrows are not limited by this embodiment and can be properly determined according to the shape of the tray 150 and other technical reasons.

An end (left end in FIG. 3) of the lower heater 130 is inserted rotatably into the cavity 100 and coupled with the cavity 100. The other end of the lower heater 130 is extended to the electronic components room 20 as described above.

Now, the operation of each part of the microwave oven will be described.

First, when an electric power is supplied to the microwave oven according to the present invention, the motor 140 rotates the lower heater 110.

The rotation angle of the lower heater 130 is determined according to the food placed on the tray 150. The lower heater 130 is rotated by the determined rotation angle such that the position of the tray 150 is determined.

The tray 150 is positioned at a predetermined height. The heat emitted from the upper heater 110 and the heat emitted from the lower heater 130 circulate inside the cavity 100 and the food in the cavity 100 is uniformly heated.

Figure 4:
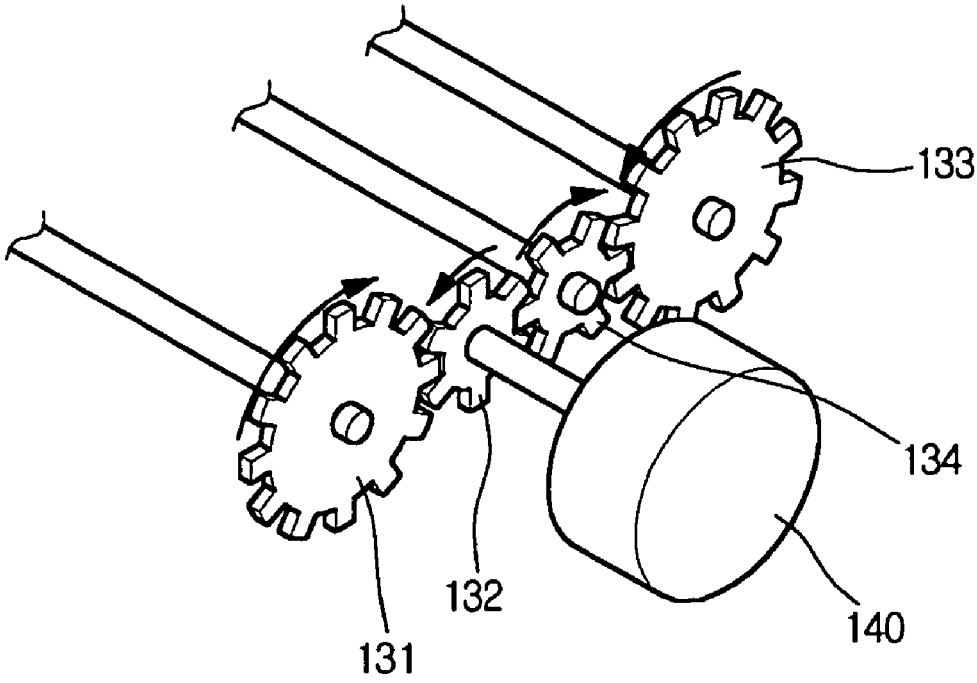
FIG. 4 is a perspective view of a rotating apparatus of a heating apparatus according to the present invention.

FIG. 4 is a perspective view of a rotating apparatus of a heating apparatus according to the present invention.

Referring to FIG. 4, in the rotating apparatus of a heating apparatus according to the present invention, a first gear 131 and a second gear 133 are coupled to the lower heater 130 extended and projected to the electronic components room 20. A first auxiliary gear 132 and a second auxiliary gear 134 engaged with each other are installed between the gears 131 and 133. The auxiliary gears 132 and 134 are engaged with the gears 131 and 133 respectively.

The motor 140 is provided to rotate the gears 131 and 133 and the auxiliary gears 132 and 134. The motor 140 is coupled with any one of the auxiliary gears 132 and 134. In this embodiment of the present invention, the motor 140 is coupled with the auxiliary gears 132. The motor 140 and the auxiliary gears 132 can be connected to each other through a shaft as an embodiment.

The remaining second auxiliary gear 134 is coupled to the outside of the cavity 100 through a shaft and rotatably installed with the shaft as an axis.

As the motor 140 rotates, the first auxiliary gear 132 coupled to the motor 140 rotates and the second auxiliary gear 134 engaged with the first auxiliary gear 132 also rotates. Then, the gears 131 and 133 engaged respectively with the auxiliary gears 132 and 134 also rotate. The lower heaters 130 connected to the gears 131 and 133 also rotate.

The rotation directions of the auxiliary gears 132 and 134, the gears 131 and 133, and the lower heater 130 will be described.

First, if the motor 140 rotates counterclockwise, the first auxiliary gear 132 connected to the motor 140 rotates counterclockwise too, and the first gear 131 engaged with the first auxiliary gears 132 rotates clockwise. Then, the first lower heater (a left lower heater shown in FIG. 2) rotates clockwise too due to the clockwise rotation of the first gear 131 and is inclined.

On the other hand, the second auxiliary gear 134 engaged with the first auxiliary gear 132 rotates clockwise due to the counterclockwise rotation of the first auxiliary gear 132. Then, the second gear 133 engaged with the second auxiliary gear 134 rotates counterclockwise due to the clockwise rotation of the second auxiliary gear 134. Then, the second lower heater 130 (a right lower heater shown in FIG. 2) rotates counterclockwise too due to the counterclockwise rotation of the second gear 133.

As described above, the motor 140 rotates the first and second lower heaters clockwise and counterclockwise respectively thereby to form an inclination.

In this embodiment of the present invention, the lower heater 130 is designed to be capable of rotating by 0° to 90° by the motor 140. In other words, when the lower heater 130 rotates by 0°, the ridge S of the lower heater 130 contacts the lower portion of the cavity 100. When the lower heater 130 rotates by 90°, the ridge S of the lower heater 130 reaches to the most distant location from the lower portion of the cavity 100.

The rotation of the lower heater 130 is determined by the rotation of the motor 140, and the rotation of the motor 140 is determined under the control of the electronic components room 20. In other words, the rotation angle of the lower heater 130 can be controlled by external manipulation according to the amount or the volume of the food.

Figure 5:
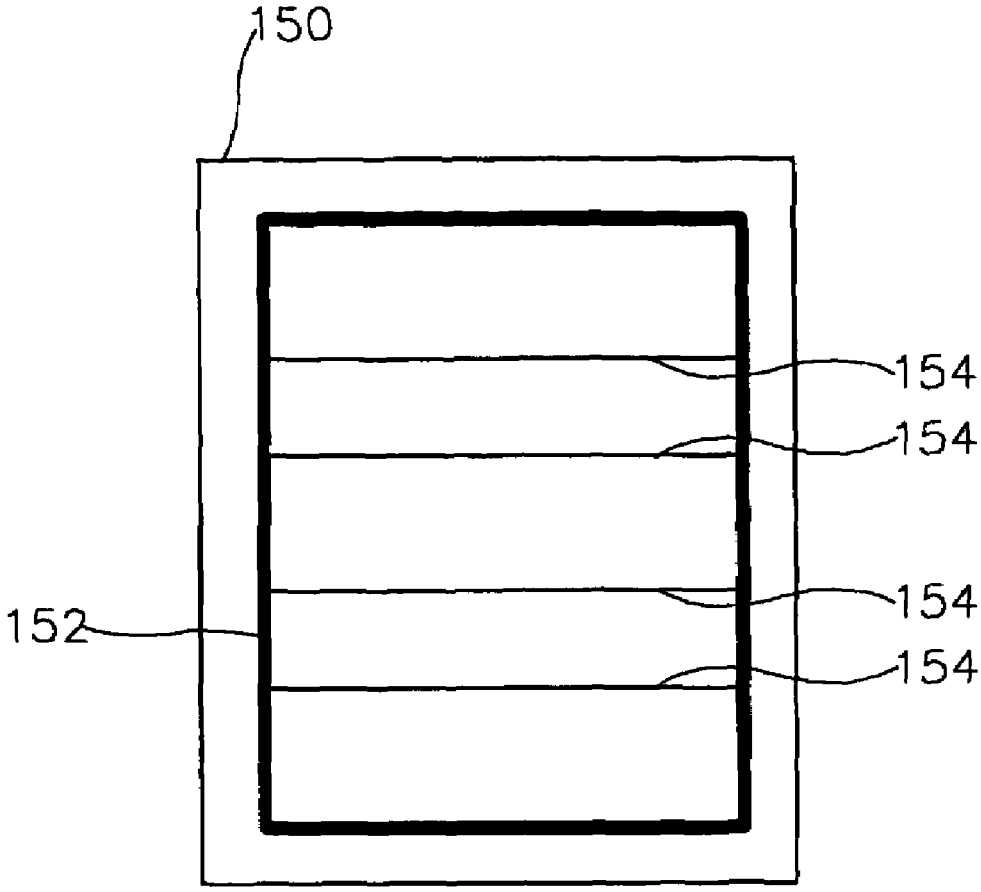
FIG. 5 is a lower portion view of a tray according to the present invention.

FIG. 5 is a bottom view of a tray according to the present invention.

Referring to FIG. 5, the tray 150 according to the present invention is placed on the lower heater 130. The tray 150 is used to receive a food and can be moved up and down due to the inclination of the lower heater 130.

As described above, the lower heater 130 contacts the lower portion of the tray 150 and forms an inclination according to the rotation of the motor 140 such that the tray 150 is lifted up.

The tray 150 has a surrounding protrusion 152 on a lower portion thereof so as to prevent the tray 150 from leaving from the lower heater 130 while the lower heater 130 rotates and moves with contacting the lower portion of the tray 150.

The tray 150 also has a lower projection 154 on a lower portion thereof so as to prevent the tray 150 from being moved due to a continuous rotation of the lower heater 130.

The surrounding protrusion 152 is formed projecting on a lower portion of the tray 150. The lower projection 154 is formed to guide a stroke that the ridge S can move, and includes a plurality of the projections formed to cross the tray 150 inside the surrounding protrusion 152.

Figure 6:
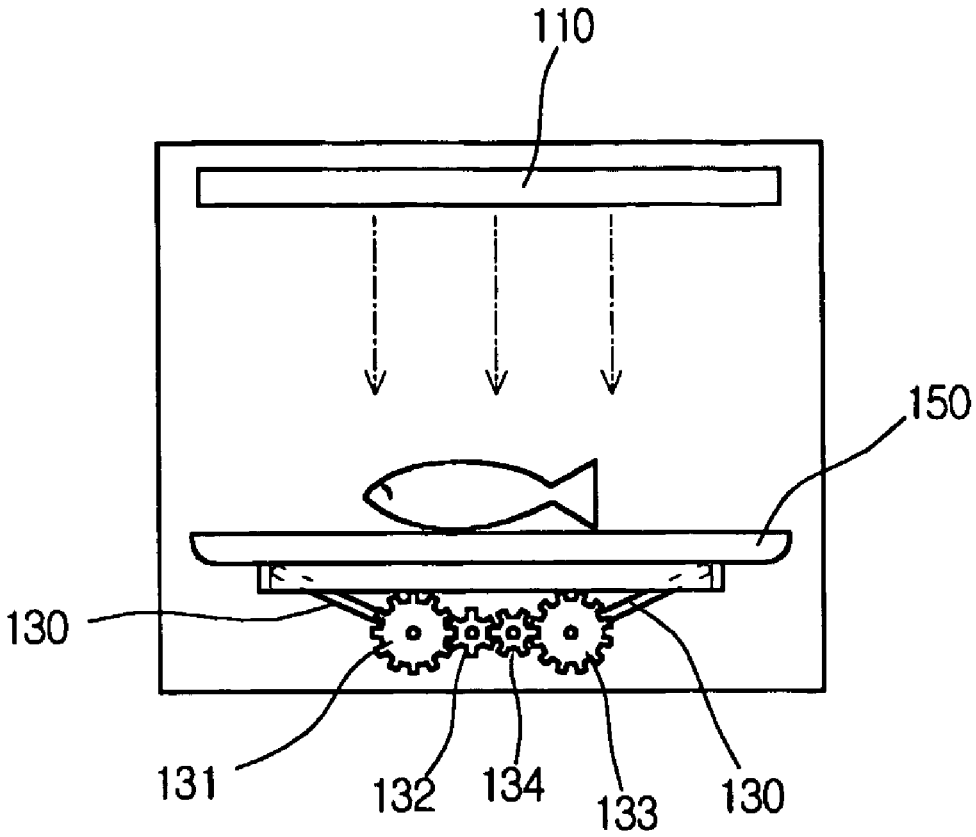
FIG. 6 is a sectional view of a tray at the lowest position of the tray according to the present invention.

FIG. 6 is a sectional view of a tray at the lowest position according to the present invention.

Figure 7:
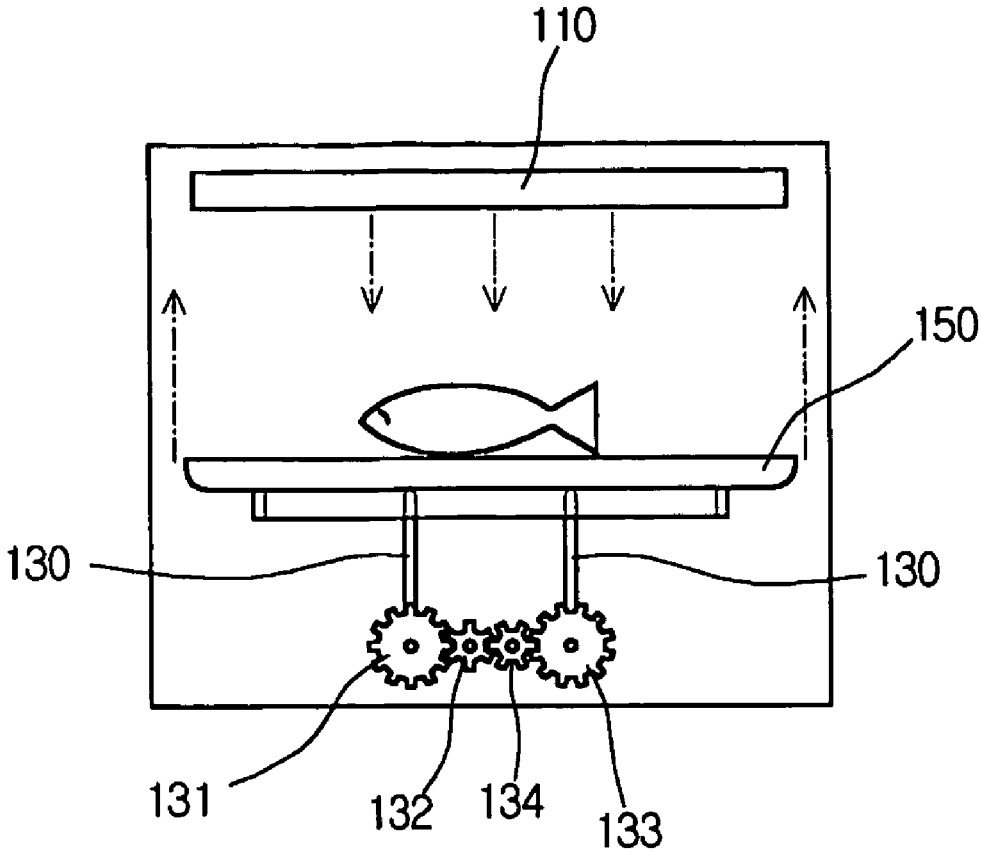
FIG. 7 is a sectional view of a tray at the highest position of the tray according to the present invention.

FIG. 7 is a sectional view of a tray at the highest position according to the present invention.

Referring to FIGS. 6 and 7, the location of the tray 150 can be easily found due to the rotation of the lower heater 130.

First, when the motor 140 does not operate, the tray 150 is positioned at the lowest location and placed on the lower heater 130 as shown in FIG. 6. When the lower heater 130 rotates by 90° by the motor 140, the tray 150 reaches to the highest location inside the cavity 100. In other words, the tray 150 is nearest to the upper heater 110.

The operation of the heating apparatus the microwave oven described above will be described.

First, a food is placed on the tray 150. Then, the upper and lower heaters 110 and 130 are turned on to emit heat.

The heat is merged into the airflow circulating inside the cavity 100 to form a thermal current, so that the heat is delivered to the food by convention. Also, the microwave oven heats the food by microwave of magnetron.

The food is cooked by the heat of the upper and lower heaters 110 and 130 and the microwave oven. In order to cook the food quickly, the motor 140 is rotated under the program of the microprocessor of the microwave oven. The torque of the motor 140 is transmitted to the lower heater 130 through the auxiliary gears 132 and 134 and the gears 131 and 133. Then, the lower heater 130 is inclined at a constant slope. The position of the tray 150 is changed in the cavity 100 due to the inclination of the lower heater 130.

When it is sufficient to cook a food by using the microwave and the upper and lower heaters 110 and 130, the food is cooked without lifting up the tray 150. However, the food can be cooked with lifting up the tray 150 according to the condition of the food.

In other words, the food can be moved near to the upper heater 110 to allow the heat of the upper heater 110 to be more easily irradiated onto the food. Then, the food can be more quickly cooked.

When the food is completely cooked, the motor 140 is reversely rotated automatically or manually to flatten the lower heater 150 and move the tray 150 to the lowest location.

The location of the tray 150 in the cavity 100 is determined under the control of the motor 140 according to the type and the size of the food.

INDUSTRIAL APPLICABILITY

According to the present invention, the tray with a food thereon is lifted up to the upper heater by the rotation of the lower heater such that the food is cooked quickly and the cooking time is shortened. The heat generated from the upper heater is efficiently irradiated on the food so that the energy efficiency of the upper heater is maximized.

The location of the tray is controlled according to the type and the size of the food such that the food is uniformly heated and more properly cooked.

While the present invention has been described and illustrated herein with reference to the preferred embodiments thereof, it will be apparent to those skilled in the art that various modifications and variations can be made therein without departing from the spirit and scope of the invention. Thus, it is intended that the present invention cover the modifications and variations of this invention that come within the scope of the appended claims and their equivalents.

The invention claimed is:

1. A heating apparatus of a microwave oven, comprising:

an upper heater installed at an upper portion of a cavity;

a lower heater installed at a lower portion of the cavity and allowing an inclination to be selectively formed;

a tray placed on the lower heater, for receiving a food thereon; and a motor connected to the lower heater so as to incline the lower heater on which the tray is placed to selectively lift and lower the tray, wherein the tray is lifted and lowered such that the tray remains approximately parallel with the upper heater.

2. The heating apparatus according to claim 1, wherein the upper heater has at least one bent portion to enhance caloric power.

3. The heating apparatus according to claim 1, wherein the lower heater has one end projecting out of the cavity, and the other end inserted rotatably into the cavity and coupled with the cavity.

4. The heating apparatus according to claim 1, wherein the lower heater has an end projecting out of the cavity, the projecting end of the lower heater being coupled with a gear.

5. The heating apparatus according to claim 1, wherein the lower heater is rotatable by 90° to the maximum extent by a rotation of the motor.

6. The heating apparatus according to claim 1, wherein the lower heater has at least one bent portion such that the tray is stably movable up and down in spite of an inclination due to a rotation.

7. The heating, apparatus according to claim 1, wherein the tray has a surrounding protrusion on a lower portion thereof such that the tray is prevented from leaving from the lower heater in spite of an inclination due to a rotation of the lower heater.

8. The heating apparatus according to claim 1, wherein the tray has projections on a lower portion thereof such that the tray is prevented from freely moving on the lower heater in spite of an inclination due to a rotation of the lower heater.

9. The heating apparatus according to claim 1, wherein the motor is rotatable in a reverse direction automatically and/or manually.

10. A heating apparatus of a microwave oven, comprising;

a lower heater installed at a lower portion of a cavity;

a tray supported by the lower heater a gear rotatably coupled at an end of the lower heater; and driving means coupled with the gear, for inclining the lower heater to selectively lift and lower the tray, wherein the tray is lifted and lowered such that the tray remains approximately parallel with the upper heater.

11. The heating apparatus according to claim 10, further comprising an auxiliary gear installed between the gears and engaged with the gears, for intermediating the gears.

12. The heating apparatus according to claim 11, wherein one of the auxiliary gears is connected to the driving means and rotated by an operation of the driving means.

13. The heating apparatus according to claim 11, wherein the auxiliary gear connected with and rotated together with the driving means is installed engaged with another auxiliary gear installed outside the cavity by a shaft.

14. The heating apparatus according to claim 10, wherein the lower heater has a bent portion, the bent portion reciprocating between at least two projections formed long on the lower portion of the tray and in parallel with a side of the tray.

15. A heating apparatus of microwave oven, comprising:

a tray installed in a cavity, for receiving a food thereon;

a lower heater for shaking the tray;

driving means for shaking the tray and force transmitting means for connecting the lower heater to the driving means, wherein the tray remains approximately parallel with the upper heater when shaken.

16. A method for heating foods in a microwave oven, the method comprising the steps of:

rotating a motor installed in the microwave oven;

rotating a lower heater by a rotation of the motor; and moving a tray up and down by a rotation of the lower heater, wherein the tray is moved up and down such that the tray remains approximately parallel with the upper heater.

17. The method according to claim 16, wherein at least one gear is installed between the motor and the lower heater to rotate the lower heater.

18. The method according to claim 16, further comprising the step of:

when cooking is finished, automatically or manually moving the tray down to return the tray to an original place thereof.

19. The method according to claim 16, wherein the motor is operated and rotated under the control of a microprocessor embedded in the microwave oven.

* * * * *